United States Patent [19]

Hoyt

[11] 4,109,394

[45] Aug. 29, 1978

[54] MATERIAL TREATMENT SYSTEM

[75] Inventor: Charles W. Hoyt, Belmont, Mass.

[73] Assignee: Wolverine Corporation, Methuen, Mass.

[21] Appl. No.: 756,896

[22] Filed: Jan. 5, 1977

[51] Int. Cl.[2] ..... F26B 17/04

[52] U.S. Cl. ..... 34/57 B; 34/156; 34/225; 302/29; 302/31

[58] Field of Search ..... 34/10, 57 R, 57 A, 57 B, 34/156, 224, 225, 232, 233; 302/29, 31

[56] References Cited

U.S. PATENT DOCUMENTS

| | | | |
|---|---|---|---|
| 2,805,898 | 9/1957 | Willis, Jr. | 302/29 |
| 3,060,590 | 10/1962 | Brown | 302/29 |
| 3,229,377 | 1/1966 | Hoyt | 34/10 |
| 3,395,943 | 8/1968 | Wilde et al. | 302/31 |
| 3,582,144 | 6/1971 | Woolard | 302/29 |

*Primary Examiner*—John J. Camby
*Assistant Examiner*—Larry I. Schwartz

[57] ABSTRACT

A system for treatment of particulate material includes a conveyor for transporting particulate material through a treatment zone, a gas flow system for placing particles on the conveyor in fluidized condition as they move through the treatment zone, and means along the side of the treatment zone for projecting a gaseous stream inwardly along the transport surface of the conveyor to provide boundary sheath gas flow along the edge of the treatment zone, the boundary sheath gas flow containing particles on the conveyor and contributing to the fluidization of particles on the conveyor at the side boundary of the particle treatment zone.

15 Claims, 5 Drawing Figures

MATERIAL TREATMENT SYSTEM

SUMMARY OF INVENTION

This invention relates to material treatment systems that employ a gaseous medium to fluidize particles in heat exchange or other treating relation and more particularly to particulate treatment systems suitable for use with transport mechanisms of the belt conveyor or similar type.

Particulate material is advantageously treated by maintaining the particles in fluidized conditions as they are transported through a particle treatment zone. The particles may be fluidized by a gas flow that is in the heat exchange or other treating relation with the particles. In particular treatment apparatus, as shown in my U.S. Pat. No. 3,229,377 for example, gas jets are directed downwardly onto an imperforate surface, the surface having integral inclined side walls which retain the particles while they are being transported through the treatment zone. Such integral side wall retention structure cannot be employed with moving transport systems of the belt conveyor type due to the necessity for the belt to round sprockets at either end of the treatment zone.

Belt type conveyors composed of metal flights or slats are preferred for use in the food industry where it is required to maintain high conditions of cleanliness. The metal flights fit closely together to form a flat moving table in a horizontal run through the particle treatment zone but are flexibly linked together to permit the belt to round a drive sprocket and return at either end of the conveyor. Lateral edge stop members that fastened to the flights and loosely overlap one another have been used but particles tend to escape through those stop members causing a cleaning problem, and in the case of food processing involve unacceptable, unsanitary conditions.

In accordance with the invention apparatus is provided for use in a particle treatment system that includes a transport conveyor that defines the lower surface of a particle treatment zone and particle fluidizing apparatus that includes an array of nozzles arranged to project gaseous streams downwardly against the conveyor surface for fluidizing particles on the conveyor in the treatment zone. Gaseous streams are projected from each side of the treatment zone inwardly along the transport surface of the conveyor to provide continuous boundary gas flow into the treatment zone. This boundary gas flow provides containment effective to prevent particles on the conveyor from passing laterally from the treatment zone and also contributes to the fluidization and treatment of particles at the side boundary of the treatment zone. These boundary gas flows also scavenge the cracks between the flights on a belt type conveyor and, as the seal is frictionless, do not impose an increased conveyor drive requirement. In preferred embodiments a boundary plenum is mounted along each side of the conveyor and has a lower surface spaced above but close to the upper surface of the conveyor. An outlet port in the boundary plenum is arranged for projecting a sheath of gas from the boundary plenun inwardly along the surface of the conveyor.

In a particular embodiment each boundary plenum is fixed in position with a lower surface disposed parallel to and immediately above the moving conveyor surface. An inclined passage at the base of each boundary plenum extends along the length of the plenum and directs gas against the conveyor surface and for flow inwardly into the treatment zone. Provision is made for adjusting the clearance between the plenum and the conveyor. The position of the conveyor-boundary plenum system is adjustable vertically relative to the fluidizing system to accommodate treatment of different particulate materials. In such embodiments, it is preferred that the pressure in the boundary plenums be greater than the pressure in the nozzle array supply plenum. The desired pressure differential may be obtained in various manners, for example with a boundary plenum supply separate from the nozzle array supply; a common nozzle matrix-boundary plenum supply with a flow restriction between the supply and the nozzle array; or booster fans in the supplies to the boundary plenums. A shoe of low friction material that preferably is segmented and extends along the length of the base of each boundary plenum provides mechanical restriction and contributes to conveyor position stability in the treatment zone.

The invention provides a versatile and efficient containment system which contributes to the particle treatment action and is particularly useful in conjunction with particle transport mechanisms of the endless belt type. Other objects, features and advantages of the invention will be seen as the following description of a particular embodiment progresses, in conjunction with the drawings, in which.

DESCRIPTION OF PARTICULAR EMBODIMENT

Figure 1:
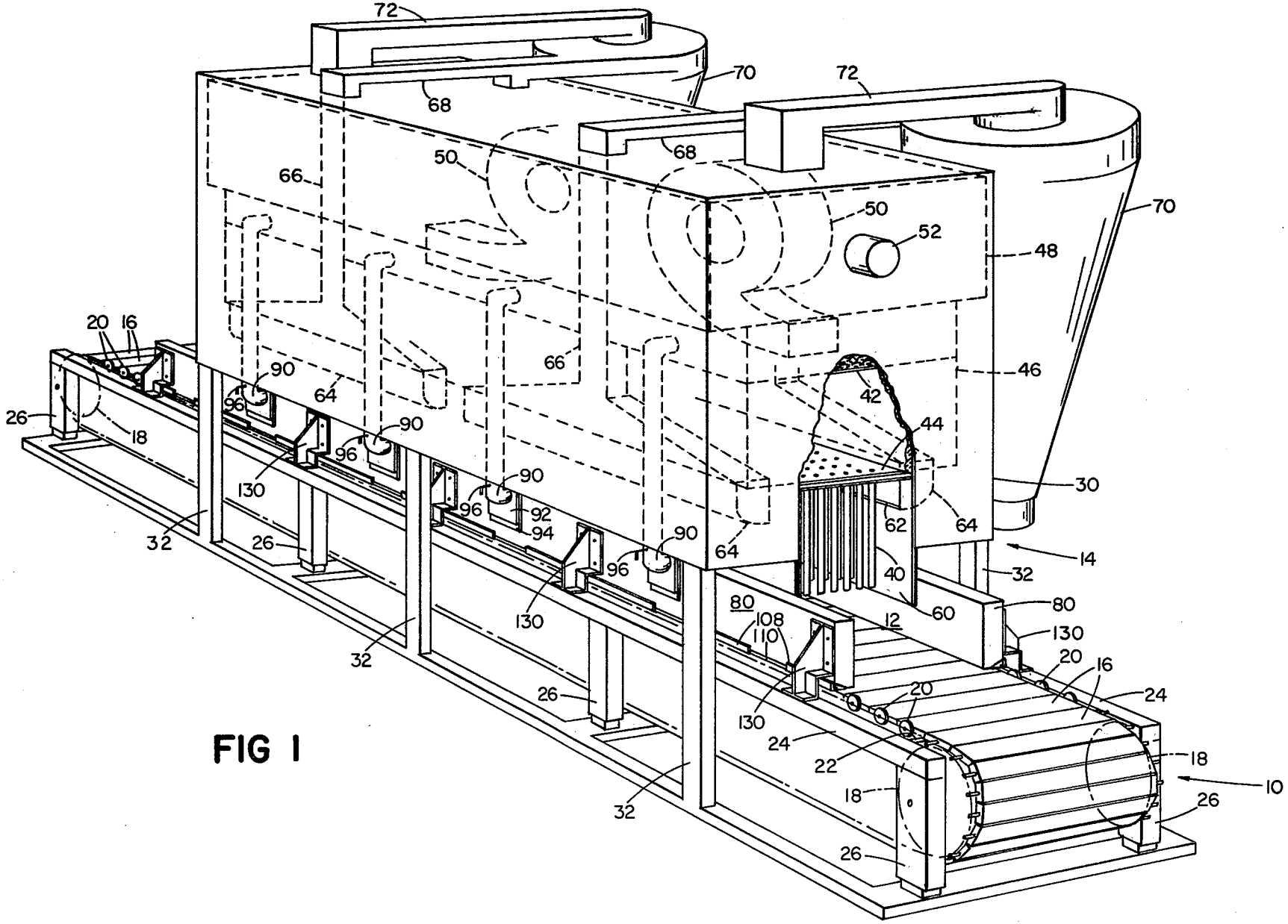
FIG. 1 is a perspective view of a particle treatment system in accordance with the invention.

The apparatus shown in FIG. 1 includes a conveyor system 10 for transport of particulate material through an elongated treatment zone 12 and an air flow system 14 that provides a flow of air for fluidizing particles as they are transported through the treatment zone 12 by the conveyor 10. The conveyor 10 is of the articulated belt type and composed of stainless steel flights or slats 16 that are hinged together so that they fit closely and form a flat moving table in the treatment zone, while also permitting the flight assembly to traverse sprockets 18 at either end of the conveyor. The flights include rollers 20 that ride on support flanges 22 secured to frame members 24 so that the series of flights 16 are positively supported in the particle treatment zone 12. The conveyor system 10 including the sprocket assemblies 18 and the support members 24 are mounted on vertical adjustable support posts 26.

The air flow system 14 provides flow of fluidizing air to the particle treatment zone 12 and includes insulated housing 30 mounted on supports 32. Extending downwardly from housing 30 toward the particle treatment zone 12 is a matrix of elongated tubes 40 that extends over the 20 foot length and 1½ foot width of the treatment zone. Each tube 40 is 20 inches in length and has an inner diameter of ¾ inch and the tubes are arranged in transverse rows that alternate four and five in number of tubes with the tubes spaced at intervals of 3½ inches on center and the transverse rows spaced lengthwise at intervals of 2½ inches on center. The upper ends of tubes 40 are secured to support member 44 which forms the lower wall of main pressure plenum 46. A conditioning plenum 48 is formed in housing 30 above pressure plenum 46 in which the air to be supplied to the treatment zone is conditioned and then transferred by blowers 50 to pressure plenum 46. In this embodiment the gas is conditioned by heaters 52 at either end of plenum 48 but it will be understood that the gas may be conditioned by cooling or otherwise as desired in other treatment systems. PJenum 46 is divided into upper section 54 and lower section 56 by apertured flow restriction barrier 58 (which may be in the form of one or more large mesh screens) so that the pressure is greater in section 54 than in nozzle array supply section 56.

Vertical walls 60 extend downwardly on either side of the matrix of tubes 40 and define side boundaries of the treatment zone. At the upper end of each side wall 60 are formed elongated exhaust ports 62 which communicates with series flow paths of exhaust chambers 64, collection ducts 66 and transfer conduits 68 at the top of housing 30 that are connected to cyclones 70. The gas from the cyclones is returned to the housing 30 through ducts 72 for flow into the conditioning plenum 48 for conditioning by heaters 52 and then transferred by blowers 50 to pressure plenum 46.

Figure 2:
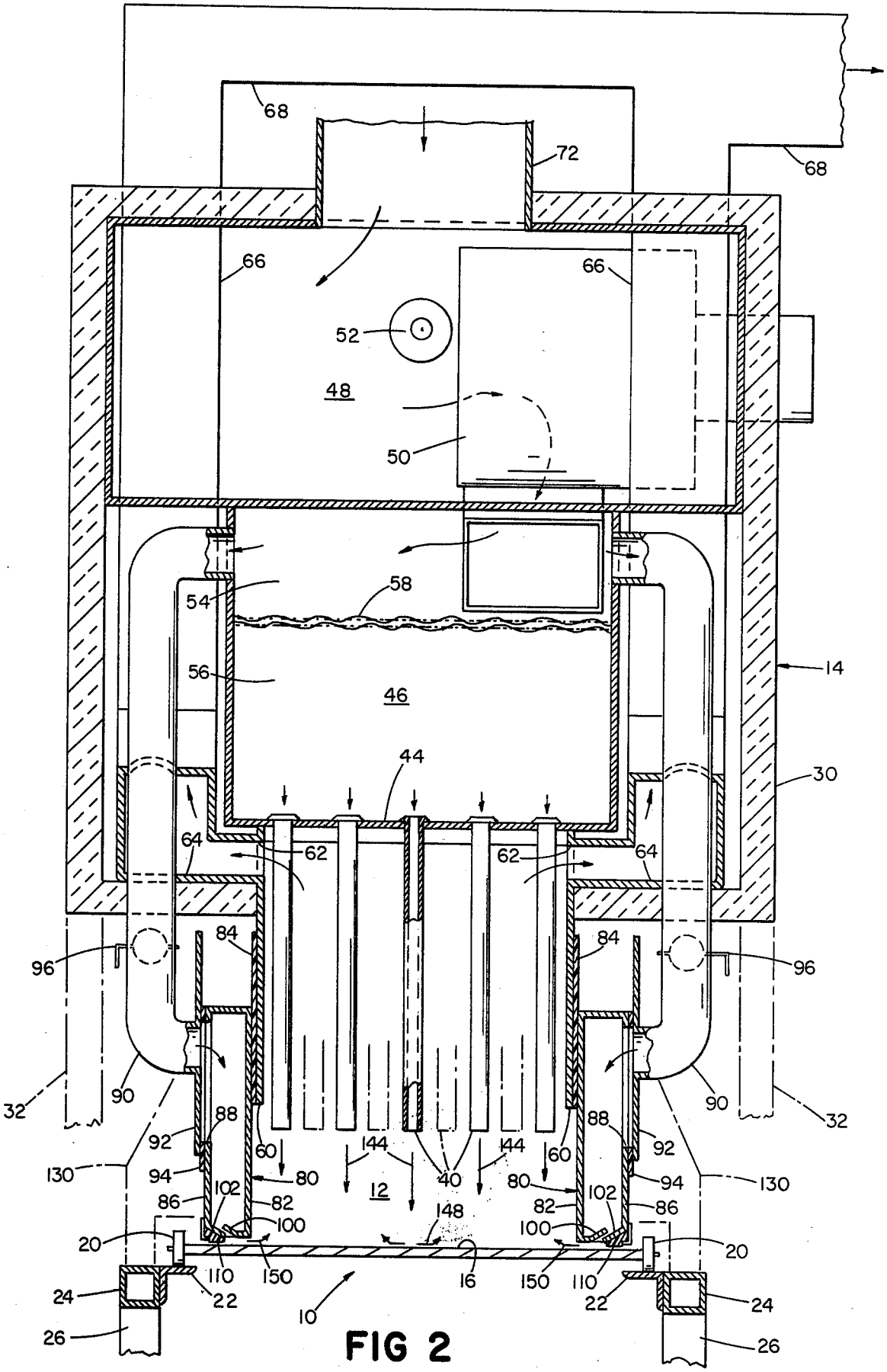
FIG. 2 is a cross-sectional view of the apparatus shown in FIG. 1.
Figure 3:
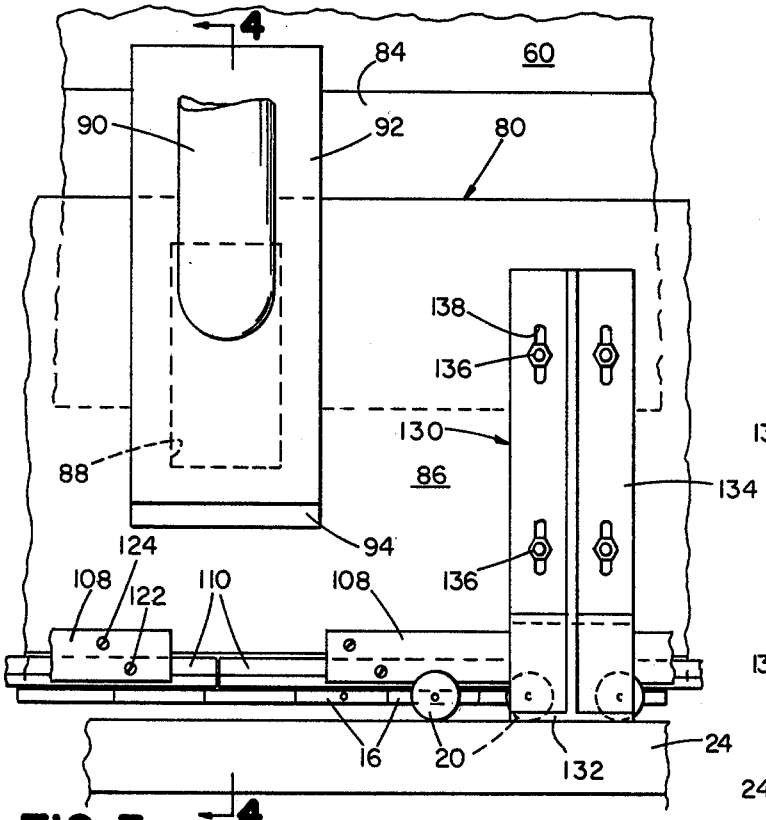
FIG. 3 is a side view of a portion of a boundary plenum and support structure employed in the system shown in FIG. 1.

Disposed along either side of the particle treatment zone 12 in engagement with side walls 60 and extending the length of the particle treatment zone is a boundary plenum 80. In this embodiment each plenum 80 has a width of 2¼ inches and a height of 12 inches and as better shown in FIG. 2 has an inner wall 82 in sliding engagement with polytetrafluoroethylene (Teflon) sheets 84 that are secured to the outer surface of side wall 60 and an outer wall 86 that has spaced elongated ports 88 for communication with supply passages 90 that extend from upper section 54 of pressure plenum 46 downwardly to ports 88. A duct flange 92 carried by conduit 90 is in sliding engagement with polytetrafluoroethylene (Teflon) seal sheet member 94 carried by outer wall 86. A damper control 96 is disposed in each supply conduit 90 as indicated in FIG. 2.

Figure 4:
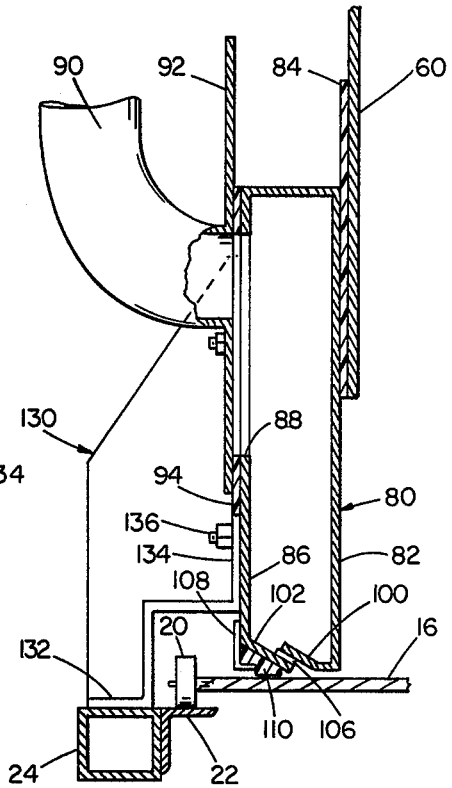
FIG. 4 is a sectional view through a boundary plenum taken along the line 4—4 of FIG. 3.
Figure 5:
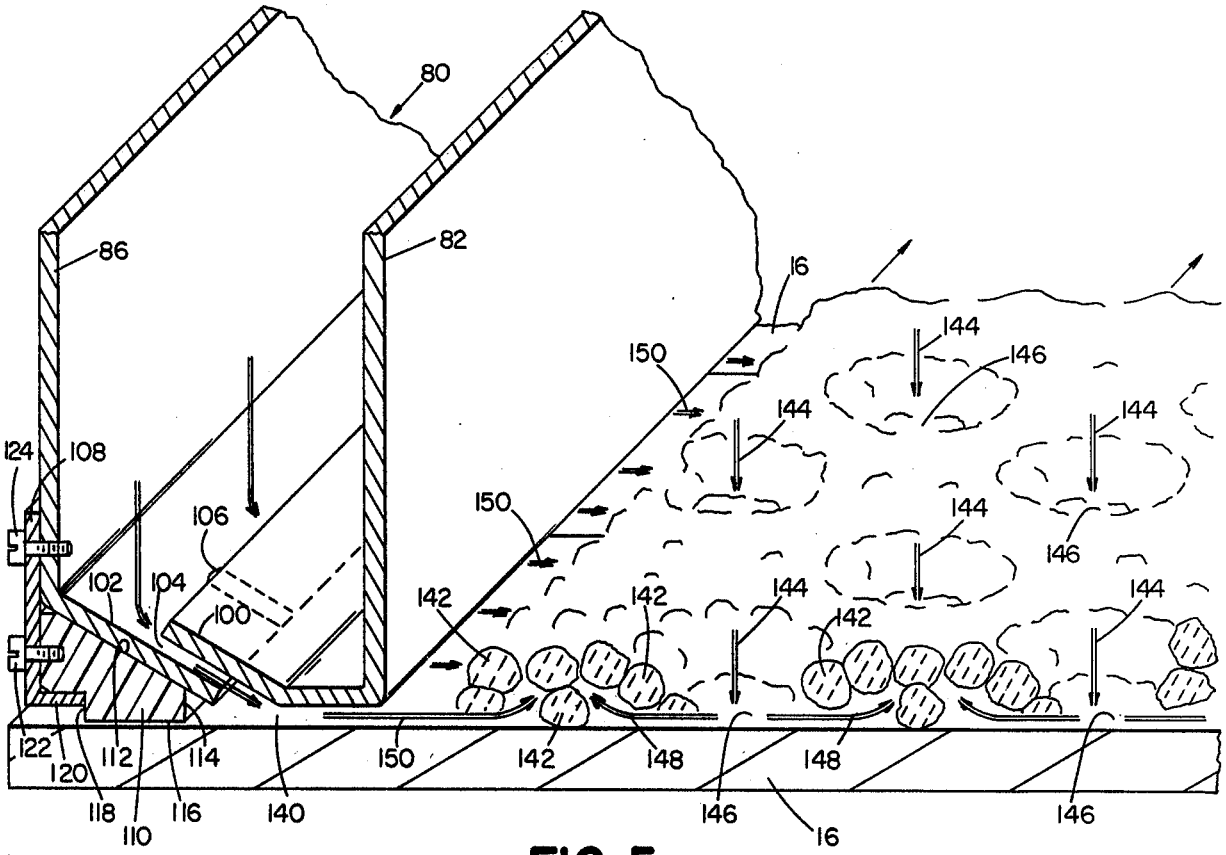
FIG. 5 is a diagrammatic view indicating the nature of gaseous flows in the processing of particulate material with the system shown in FIG. 1.

With reference to FIGS. 4 and 5, the inner wall 82 of each boundary plenum has a horizontal bottom flange with a section 100 bent upward at an angle of 30°. Outer wall 86 has a similar bottom flange 102 that extends downwardly at an angle of 30° and overlaps flange section 100 ½ inch. The resulting elongated slot 104 (with spacers 106) provides an inclined discharge port 3/32 inch in width that extends the length of the treatment zone. Secured against the bottom surface of flange 102 by clamp plates 108 are a series of low friction (Teflon) shoes 110 (each about 2 feet long) that extend the length of each boundary plenum. Each block 110 has an inclined surface 112 that mates with flange 102, a vertical front surface 114 and a horizontal lower surface 116. Notch 118 receives flange 120 of clamp plate 108, and bolts 122 secure blocks 110 to plates 108 while bolts 124 secure the plate-shoe assemblies to plenum 80.

Each boundary plenum 80 is supported from conveyor frame member 24 by brackets 130 that are permanently secured to frame member 24 by horizontal flanges 132 and that have vertical flanges 134 to which the outer wall 86 of the boundary plenum are secured by fasteners 136. Elongated slots 138 permit adjustment of the vertical position of the boundary plenum 80 relative to the top surface of conveyor 16 over a limited range so that the lower surface 118 of Teflon member 110 may be positioned close to the upper surface of the conveyor, a nominal shoe-conveyor spacing being 1/64 inch, and the height of the horizontal extension 140 of inclined sheath gas passage 104 being about ⅛ inch.

FIG. 5 illustrates in diagrammatic form processing of particles 142 as they are transported through zone 12 by conveyor 10. Heated air from lower section 56 of pressure plenum 46 flows through tubes 40 in high velocity streams 144 directed perpendicularly downwardly toward the conveyor flights 16. The velocity of jets 144 is such that they tend to blow particles 142 away from the conveyor surface areas 146 directly beneath the jets and thus expose those areas. When the jets 144 impact the imperforate surface of the conveyor, the air is deflected radially outwardly from the axis of each jet as indicated by arrows 146 substantially uniformly around a 360° arc. This radial flow 146 tends to pass under particles 142 on the conveyor and lift them off the conveyor flights 16 in a fluidizing action. Concurrently, heated air from upper section 54 of pressure plenum 46 flows through supply pipes 90 to boundary plenums 80. Preferably the pressure in plenums 80 is at least as great as in pressure plenum section 56. A sheath of air indicated by arrows 150 flows from each boundary plenum 80 downwardly through inclined passage 104 and then inwarly below each boundary plenum through horizontal passage 140 and along the surfaces of the conveyor flights 16 to move particles 142 inwardly away from the boundary of the treatment zone. The sheath flow 150 also tends to pass under particles 142 and lift them off the conveyor surface and thus contribute to the fluidizing and particle treatment actions of the radial gas flows 146 from vertical jets 144. The staggered arrangement of nozzles 40 in successive transverse rows produces lateral movement of the fluidized particles 142 on the conveyor 10 as the particles are advanced through the treatment zone 12 by the conveyor. The boundary sheath gas flow 150 also provides scavenging action of the joints between the conveyor flights 16.

Adjustable supports 26 permit the vertical position of conveyor 10 to be changed to adjust the spacing between the lower ends of tubes 40 and transport surface 16. During such adjustment, boundary plenums 80 move as a unit with conveyor 10, with inner walls 82 sliding on plastic sheets 84 and plastic sheets 94 sliding on seal plates 92. Thus the conveyor-plenum seal arrangements and dimensions of flow passages 140 remain the same over a range of vertical spacings between the fluidizing jet tubes and the conveyor.

This fluidizing system is of particular use in the food industry for drying, roasting or otherwise treating food products such as coffee beans, grains and cereals, and for dehydrating vegetables, but has numerous other heating, cooling and chemical reaction applications including such industrial uses as conditioning plastic particles, rubber particles, etc. The air flows from the boundary plenums provide containment functions and contribute to fluidizing and particle treatment action in a frictionless seal arrangement that does not impose increased drive requirements in the conveyor system. Various gas flow arrangements may be employed depending on particular applications. For example, the boundary plenums 80 may be supplied with gas from a separate source—and that gas may have temperature and/or pressure characteristics different from the gas in plenum 46, and in such cases the apertured barrier 58 may be omitted from plenum 46. In another arrangement booster fans may be provided in supply pipes 90 to increase the boundary sheath flow.

While a particular embodiment of the invention has been shown and described, various modifications will be apparent to those skilled in the art and therefore it is not intended that the invention be limited to the disclosed embodiment or to details thereof and departures may be made therefrom within the spirit and scope of the invention as defined in the claims.

What is claimed is:

1. In a system for treatment of particulate material comprising a conveyor for transporting particulate material through a treatment zone and a gas flow system for placing particles on the conveyor in fluidized condition as they move through the treatment zone, the improvement of means along the side of the treatment zone for projecting a gaseous stream downwardly against and inwardly along the transport surface of the conveyor to provide boundary sheath gas flow along the edge of the treatment zone, said boundary sheath gas flow containing particles on said conveyor and contributing to the fluidization of particles on the conveyor at the side boundary of the particle treatment zone.

2. In a system for treatment of particulate material comprising a conveyor for transporting particulate material through a treatment zone and a gas flow system for placing particles on the conveyor in fluidized condition as they move through the treatment zone, the improvement of means along the side of the treatment zone for projecting a gaseous stream inwardly along the transport surface of the conveyor to provide boundary sheath gas flow along the edge of the treatment zone, said gas stream projecting means including a boundary plenum structure having a lower surface positioned closely adjacent the transport surface of said conveyor, and port structure in said boundary plenum structure defining a passage that directs gas downwardly from a point beneath said boundary plenum structure for flow inwardly along the surface of the conveyor, said boundary sheath gas flow retaining particles on said conveyor and contributing to the fluidization of particles on the conveyor at the side boundary of the particle treatment zone.

3. In a system for treatment of particulate material comprising a conveyor for transporting particulate material through a treatment zone and a gas flow system for placing particles on the conveyor in fluidized condition as they move through the treatment zone, the improvement of means along the side of the treatment zone for projecting a gaseous stream inwardly along the transport surface of the conveyor to provide boundary sheath gas flow along the edge of the treatment zone, said gas stream projecting means including a boundary plenum structure having a lower surface positioned closely adjacent the transport surface of said conveyor, port means in said boundary plenum through which said gas stream flows and a shoe of low friction material spaced from but close to said transport surface, said boundary sheath gas flow retaining particles on said conveyor and contributing to the fluidization of particles on the conveyor at the side boundary of the particle treatment zone.

4. The system as claimed in claim 3 and further including support structure for positioning said boundary plenum structure in fixed relation to the transport surface of said conveyor, and wherein said port means is located inwardly of said shoe and directs said gaseous stream downwardly against said transport surface for flow inwardly along said transport surface.

5. In a system for treatment of particulate material comprising a conveyor for transporting particulate material through a treatment zone and a gas flow system for placing particles on the conveyor in fluidized condition as they move through the treatment zone, said gas flow system comprising a supply plenum above said treatment zone, an array of nozzles extending along the length of the particle treatment zone and across the width of the zone and arranged for flowing gas from said supply plenum downwardly in high velocity streams toward said conveyor for fluidizing particles on said conveyor, and means for exhausting gas from said high velocity streams and said boundary sheath gas flow upwardly away from said treatment zone, the improvement of means along the side of the treatment zone for projecting a gaseous stream inwardly along the transport surface of the conveyor to provide boundary sheath gas flow along the edge of the treatment zone, said boundary sheath gas flow containing particles on said conveyor and contributing to the fluidization of particles on the conveyor at the side boundary of the particle treatment zone.

6. The system as claimed in claim 5 and further including conduit means extending between said supply plenum and said gaseous stream projecting means for supplying gas under pressure for said boundary sheath gas flow.

7. The system as claimed in claim 6 and further including a flow restriction between said supply plenum and said nozzle array so that gas supplied to said gaseous stream projecting means is at higher pressure than gas supplied to said nozzle array.

8. The system as claimed in claim 5 and further including adjustment mechanism for changing the vertical spacing between said nozzle array and said transport surface while maintaining said gas stream projecting means in fixed relation to said transport surface.

9. The system as claimed in claim 8 wherein said conveyor is of the endless belt type.

10. A particle treatment system comprising:

structure defining a particle treatment zone including a belt type conveyor defining the lower boundary of the particle treatment zone and being arranged for transporting particulate material through the treatment zone, a supply plenum above said particle treatment zone, an array of nozzles arranged to project gaseous streams downwardly from said supply plenum against said conveyor surface for fluidizing particles on said conveyor, means for exhausting gases from said treatment zone upwardly away from said conveyor, a boundary plenum extending along each side of said treatment zone, each said boundary plenum having a lower surface positioned closely adjacent but spaced from the transport surface of said conveyor, a conduit to supply gas to each said boundary plenum, and ports in each said boundary plenum for projecting gaseous streams inwardly along the transport surface of said conveyor to provide boundary gas flow into said treatment zone along the length of each side of said treatment zone to prevent particles on said conveyor from passing beneath the lower surfaces of said boundary plenums and to contribute gas flow for fluidization of particles on said conveyor along the side boundaries of said treatment zone.

11. The system as claimed in claim 10 wherein each said boundary plenum has port structure in its lower surface defining an inclined passage that directs gas flow from a point beneath said boundary plenum inwardly along said transport surface.

12. The system as claimed in claim 11 wherein each said boundary plenum includes a shoe of low friction material spaced from but close to said transport surface.

13. The system as claimed in claim 12 and further including support structure for positioning said boundary plenums in fixed relation to the transport surface of said conveyor and adjustment mechanism for changing the vertical spacing between said nozzle array and said transport surface.

14. The system as claimed in claim 12 wherein gas supplied to said boundary plenums is at higher pressure than gas supplied to said nozzle array.

15. The system as claimed in claim 12 wherein each said boundary plenum has two vertical side walls, each with an inturned lower flange, said inturned lower flanges overlapping one another and defining said inclined passage and said shoe is formed of a series of polytetrafluoroethylene members that are secured to the outer side wall and extend along the entire length of the boundary plenum.

* * * * *